United States Patent [19]

Wilke et al.

[11] 4,422,616

[45] Dec. 27, 1983

[54] SUPPORT ARM FOR FASTENING TO A WALL

[75] Inventors: Rudolf Wilke, Arolsen; Horst Jäger, Edertal; Winfried Scholl, Düsseldorf, all of Fed. Rep. of Germany

[73] Assignee: Rudolf Wilke, et al., Fed. Rep. of Germany

[21] Appl. No.: 117,721

[22] Filed: Feb. 1, 1980

[30] Foreign Application Priority Data

Feb. 9, 1979 [DE] Fed. Rep. of Germany ..... 2905031

[51] Int. Cl.[3] ..... A47B 57/04; A47B 96/14

[52] U.S. Cl. ..... 248/544; 248/250; 248/274; 248/475 R; 108/152; 211/90

[58] Field of Search ..... 248/235, 239, 475 R, 248/179, 180, 250, 274, 485, 544; 211/90; 52/36; 108/152

[56] References Cited

U.S. PATENT DOCUMENTS

| | | | |
|---|---|---|---|
| 3,333,555 | 8/1967 | Kapnek | 211/90 X |
| 3,498,655 | 3/1970 | Arms et al. | 52/285 |
| 3,547,472 | 12/1970 | Ehrman | 52/285 X |
| 3,834,092 | 9/1974 | Whisson | 52/36 |
| 3,848,388 | 11/1974 | Bretche | 52/285 X |
| 3,866,364 | 2/1975 | Pollard | 52/36 |
| 3,891,335 | 6/1975 | Feil | 403/381 X |

FOREIGN PATENT DOCUMENTS

| | | | |
|---|---|---|---|
| 480735 | 3/1938 | Australia . | |
| 6806393 | 11/1968 | Fed. Rep. of Germany . | |
| 7021306 | 12/1970 | Fed. Rep. of Germany . | |
| 2144563 | 3/1973 | Fed. Rep. of Germany . | |
| 7243750 | 5/1973 | Fed. Rep. of Germany . | |
| 2601353 | 7/1977 | Fed. Rep. of Germany . | |
| 7630718 | 9/1978 | Fed. Rep. of Germany . | |
| 2905031 | 8/1980 | Fed. Rep. of Germany | 248/250 |
| 1101988 | 4/1955 | France | 248/239 |
| 303483 | 2/1955 | Switzerland . | |

*Primary Examiner*—Robert Mackey

*Attorney, Agent, or Firm*—Townsend and Townsend

[57] ABSTRACT

A support arm for fastening to a wall features four longitudinally extending grooves displaced at 90° intervals around its periphery and a central bolt for fixing the support arm by one end face to a wall. The grooves are adapted to receive the marginal edges of both shelf and side wall members and can be filled when not in use by removable elongate filling pieces. The arrangement also features locking grub screws interconnecting neighboring pairs of grooves for securing the shelves and side wall members and a further arrangement of grub screws extending parallel to the axis of the support arm and accessible through the grooves for adjusting the inclination of the support arm to the wall.

In a further modification the support arm includes a support for a mirror which can be arranged to form the back wall member of a shelving unit.

25 Claims, 9 Drawing Figures

Figure 6:
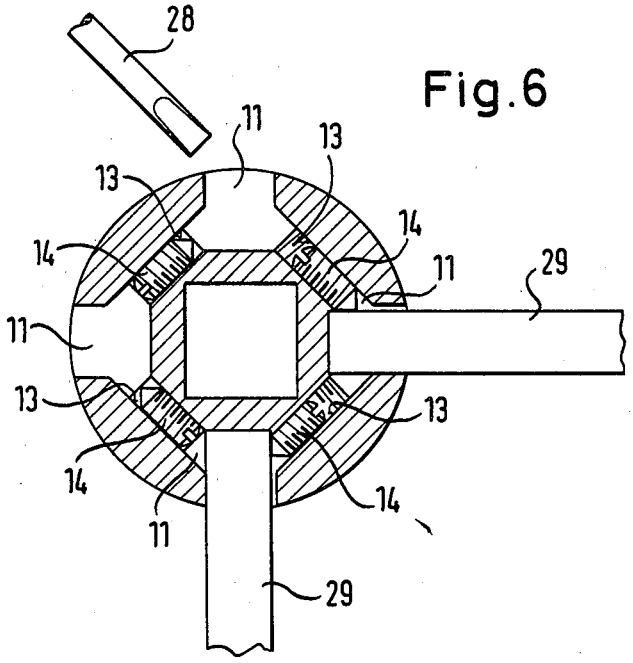

Fig.1
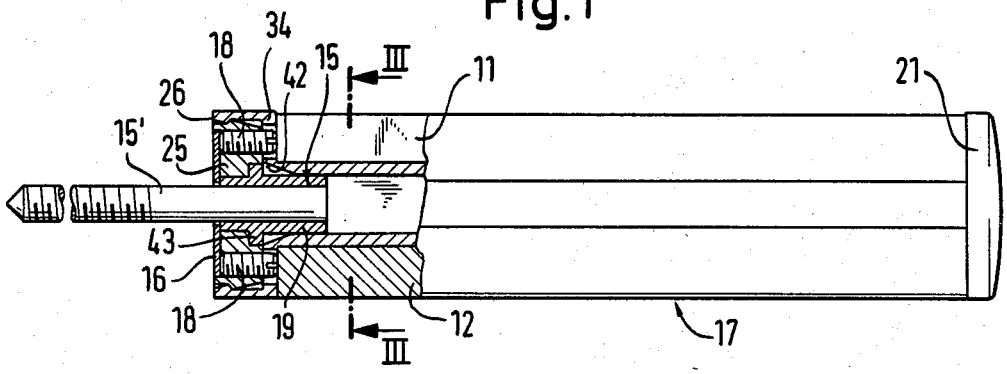
Fig.2
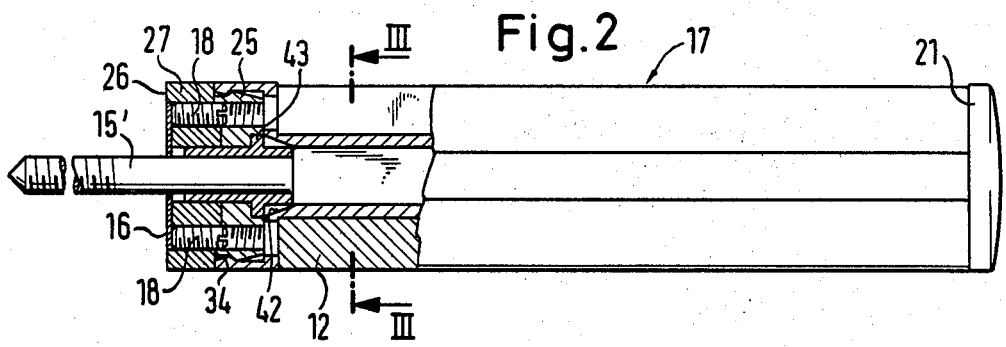
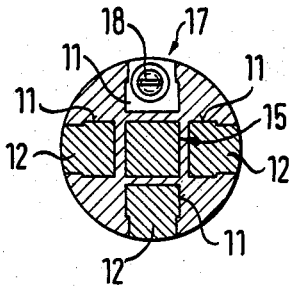
Fig.3
Fig.4
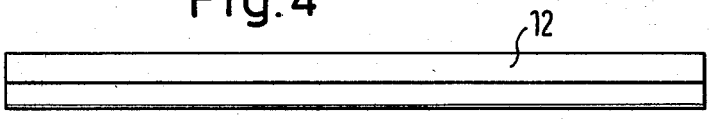
Fig.5
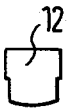

SUPPORT ARM FOR FASTENING TO A WALL

The invention relates to a support arm for fastening to a wall and has particular reference to a support arm of the kind which is used to support a plate member such as a shelf against the wall by means of a longitudinal groove into which a marginal edge region of the shelf is inserted.

Support arms are already known in the form of round bars which are adapted to be fastened by an end face to a wall and which are each provided with a side disposed groove into which a glass plate can be inserted. Shelving brackets are also already known from German Patent Specification DE-PS No. 21 44 563 on which shelves can be placed after the brackets have been fastened to a wall.

The principal object underlying the present invention is to provide a support arm of the kind initially named by means of which not only shelving but also side plates and if necessary, also back plates or mirrors can be fastened to a wall. A further main object of the present invention is to provide a support arm which can be simply manufactured and which eases stock holding problems. A further object of the invention is to avoid the danger of the support arm distorting even when it is of synthetic plastic material.

In order to accomplish these objects, there is envisaged, in accordance with the present invention, a support arm for fastening to a wall, the arm having four longitudinally extending grooves displaced at 90° intervals around its periphery, said grooves being adapted to receive, as required, the marginal edge regions of associated plate members which are intended to be supported by the arm and being closable when not required to so receive associated plate members by removable elongate filling pieces.

In this manner, support arms which can be combined and used with other similar elements can be employed in diverse ways not only to support shelving or corresponding glass plates but also to support vertically directed walls between pairs of support arms arranged one above the other.

By filling the grooves which preferably extend from one end of the support arm to the other with removable elongate filling pieces which are preferably resilient, stock holding and manufacture are considerably simplified because only a single type of support arm needs to be manufactured which can then be converted rapidly and simply for any particular purpose by removing the filling pieces from the grooves which are required for the associated plate members.

When manufacturing the support arms in synthetic material, the construction is also particularly simplified by virtue of the symmetrical construction. Furthermore, if shrinkage takes place, the support arm will remain straight. This is of particular significance during manufacture because a bar with one or three grooves easily distorts during solidification or due to so-called post solidification contraction. The provision of four filling pieces means that only a single injection mould is necessary in place of four moulds.

Neighbouring grooves are advantageously connected by threaded passages at at least one point along their lengths with grub screws being screwed into the threaded passages in order to secure the inserted plate members.

The screw threaded passages usefully extend at angles of 45° to the planes occupied by plates when in position in the associated grooves. The grub screw tips should usefully have conical points of 90° included cone angle and should be provided with means, such as screw driver slots, at their tail ends so that they may be rotated to clamp against inserted plate members. In this way, plate members of glass, wood or plastic can be readily clamped in position in at least three grooves of each support arm.

Two possibilities exist for fastening such support arms or bars, which generally have no collar, to the wall. Either a long set screw extends along the axis of the support arm and is then threaded into the wall or a very short set screw can be used at the end of a cavity in the support arm.

In an arm of this kind which includes a central bolt for fastening it by an end face to a wall, the invention envisages that a pressure plate, defining the abutment surface with the wall, is movably arranged around the bolt at its first end face and that the pressure plate can be adjusted about an axis at right angles to the axis of the bolt by means of adjustment screws provided in the support arm around the bolt. The bolt is preferably surrounded by a steel sleeve in the vicinity of the abutment surface.

The steel sleeve conveniently includes a radially directed load spreading flange.

Tightening of the adjustment screws allows the central bolt to be aligned when it is unintenionally not threaded at right angles into the wall. This embodiment is particularly suitable for support arms which include a central bolt which extends deep into the support arm. The invention is, however, basically also suitable for use with relatively short fastening bolts.

Three adjustment screws would in principle be sufficient to align the central bolt, however, four are preferred in view of the provision of four grooves so that the adjustment screws can be readily reached through the grooves. Moreover, the provision of four adjustment screws facilitates intuitive alignment of the central bolt by sequential adjustment in the x and y directions of an imaginary coordinate system. The steel sleeve which surrounds the central bolt at its root makes the root area more rigid and makes it easier to align the support arm on the bolt by means of the adjustment screws.

A mirror holder can, in addition, be arranged on the support arm in the vicinity of the abutment surface so that in addition to the side walls, a rear wall, for example, in the form of a mirror, can also be attached to a wall by means of the support arms.

Figure 9:
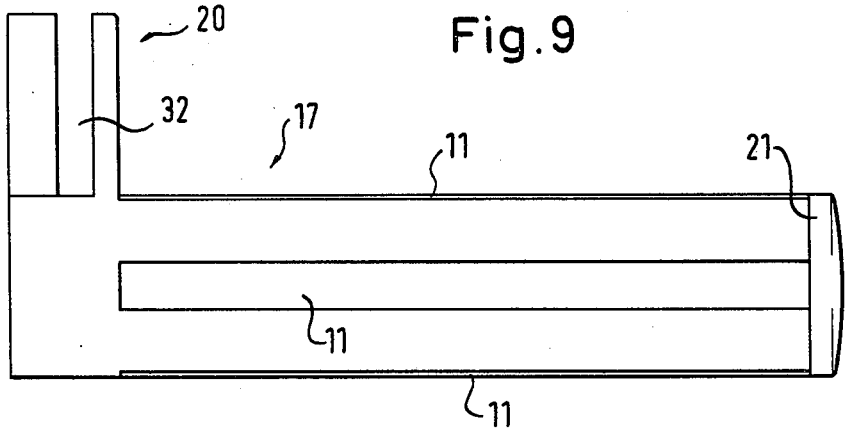
Figure 7:
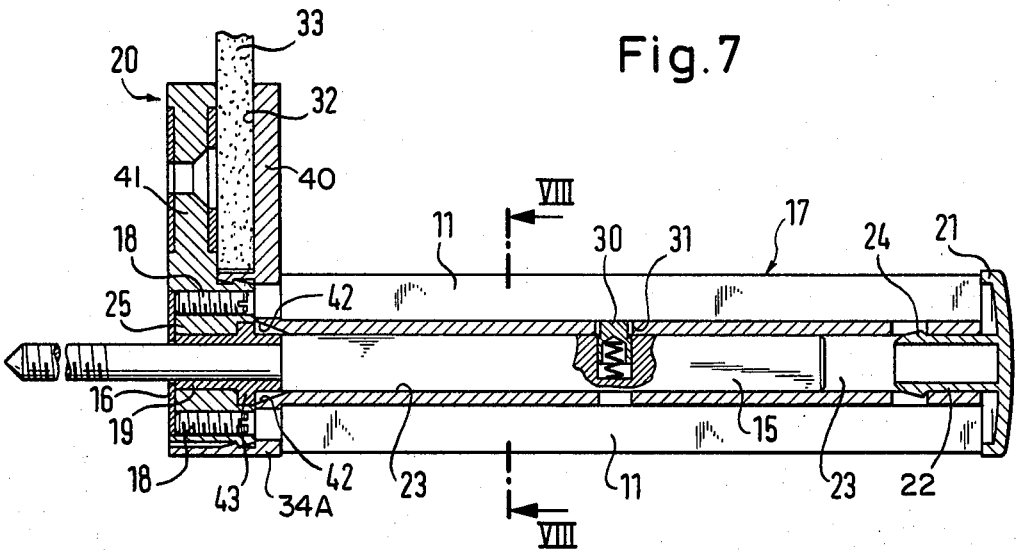
Figure 8:
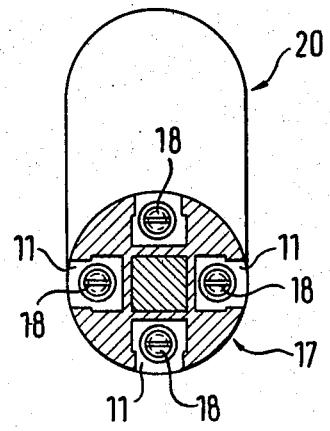

The invention will now be more particularly described by way of example only and with reference to the accompanying drawings in which are shown:

FIG. 1 a partially sectioned side view of the first embodiment of a support arm in accordance with the present teaching, FIG. 2 a partially sectioned side view of a somewhat modified embodiment;

FIG. 3 a section on the line III—III of either of the embodiments of FIGS. 1 and 2, FIG. 4 a side view of a filling piece such as is used in the support arms of FIGS. 1 and 3, FIG. 5 an end view of the subject of FIG. 4, FIG. 6 a cross-section of a further embodiment of a support arm in accordance with the present teaching and showing a particularly preferred groove shape, FIG. 7 a longitudinal section of a support arm generally similar to the support arm shown in FIGS. 1 through 3 and provided with filling pieces and, in addition, a support bracket for a rear wall member, FIG. 8 a section on the line VIII—VIII of FIG. 7 with the filling pieces removed, and FIG. 9 an side view of the subject of FIGS. 7 and 8.

Referring firstly to FIGS. 1 to 5, there is shown a support arm 17 which is constructed as a bar of plastic material of a generally circular cross-section and which is provided with four longitudinally extending grooves 11 displaced at 90° intervals around its periphery. The longitudinally extending grooves 11 have the shape which can be seen from FIG. 3. As can be seen from this drawing, the grooves are of somewhat wider construction in the interior part of the arm 17 so that an elongate filling piece 12 constructed as seen in FIGS. 4 and 5 and which is resilient and matched to the shape of the grooves 11 can be pressed from the outside into the grooves 11. The filling pieces 12 then completely fill the grooves and of their own accord no longer come out of the grooves 11. The filling pieces 12 can be readily removed by hand with a tool from the grooves 11.

The grooves 11 extend in depth up to the vicinity of a centrally arranged set bolt 15 which has a square cross-section over the larger part of its length but which, however, is of circular cross-section at the part 15′ which faces the wall. The circular end portion 15′ projects beyond the end of the support arm 17 and is preferably provided with threads and a point so that the support arm can be readily screwed into a bore in the wall. As can be seen from FIG. 1, the grooves 11 extend in the longitudinal direction up to an end cap 21 which can be snapped into the central aperture provided for the set screw 15. The end cap is thus fitted by means of a plug connection to the support arm and closes the grooves at their outer ends. The fastening of the end cap can be seen in detail from FIG. 7 from which it is apparent that the shaft 22 engages in the longitudinal bore 23 for the set screw 15 and is connected via a plug or snap connection 24 with the support arm 17.

The grooves 11 do not extend at the wall side entirely up to the end of the support arm 17 but finish at a flange member 25. Adjustment screws 18 are screw threaded, in the vicinity of each groove 11 and, in the manner which can be seen from FIGS. 1 to 3, into the flange member 25 from the outer end face. A circular steel washer or pressure plate with a central aperture is placed on the central bolt 15 in the vicinity of the abutment surface 26 with the wall. The pressure plate lies in a recess in the flange member 25 such that the flange 25 and the steel washer 16 lie flush with one another. The adjustment screws 18 bear from the inside of the flange member on the pressure plate 16.

After the support arm shown in FIGS. 1 to 3 has been screwed into a wall by means of its projecting end 15′, the abutment surface 26 contacts the wall surface. Rotation of the support arm is continued until the grooves are directed in horizontal and vertical directions. If the support arm 17 is not yet aligned at right angles to the wall then the four adjustment screws 18 are rotated towards or away from the steel disc 16 until the right angled alignment is achieved.

One or more filling pieces 12 are removed from the associated grooves 11 depending on the arrangement of plate members which it is desired to support on the support arm 17.

In the embodiment of FIG. 2, a distance piece is placed between the flange member 25 and the pressure plate and ensures a somewhat greater spacing of the support arm 17 from the walls. A distance piece of this kind can conveniently be used in connection with the embodiment of FIGS. 7 and 8.

The round part 15′ of the central set bolt 15 is surrounded at its portion just inside of the support arm 17 by a steel sleeve 19 which favours the perpendicular alignment of the arm relative to the wall on adjustment of the adjusting screws 18.

The embodiment of FIG. 6 shows a particularly advantageous shape for the grooves 11. These grooves are enlarged at their lower ends so that threaded passages 14 can be provided between neighbouring pairs of grooves. These threaded passages are so directed that grub screws 14 can be fitted into the passages and can be rotated by means of a screw driver 28 which can be introduced from one side into the grooves 11. The threaded passages are arranged at angles of 45° to the plates which are inserted in the grooves. The conical points of the grub screws 14 have an included cone angle of substantially 90° so that the bolts 29 are uniformly clamped into the grooves 11. The threaded passages 13 are preferably only provided at one point along the length of the grooves 11 but can, however, basically also be present in a multiple arrangement in a groove.

FIG. 7 shows first of all how the synthetic part of the support arm 17 can be arranged in simple manner on the central bolt 15. A spring location device comprising a spring biased plug 30 arranged in the illustrated manner in the central set screw 15 can engage radially in a counter bore 31 in the synthetic part of the support arm 17 to locate the central set screw relative to the support arm.

In the embodiments of FIGS. 7 and 8, the flange member 25 has been injection molded together with an arm for supporting a mirror or a rear wall 20.

Thus the marginal edge of a mirror 33 can be inserted from above into the slot 32 provided in the mirror holder 20.

FIG. 9 shows the support arm 17 together with the mirror holder 20 as seen from the side.

Whereas in the preceding description it has been assumed that the flange member 25 and also, if provided, the mirror holder 20, are made in one piece with the end of the support arm 17, the construction is preferably arranged in accordance with FIGS. 1 and 2 and 7 such that the flange member is a separate component which is retained at the wall end of the grooves 11 by a thin radially outwardly positioned flange part 34 of the main body of the support arm. This flange part has bores through which the adjusting screws 18, or alternatively a screw driver for adjusting these adjusting screws can pass, in addition to the axially extending spring cap part 34A: the separately formed flange. The separately formed flange member 25 can be snapped into position inside the spring cap from its open side so that the two parts are joined by a form of plug connection. The flange member 25 supports at its inside the steel sleeve 19 and is provided with threaded bores for the adjustment screws 18. The aforementioned pressure plate 26 is located in these embodiments in a recess in the end of the flange member.

In the embodiment of FIG. 7, the mirror holder 20 basically consists of first and second radially directed arms 40, 41 with a slot 32 formed therebetween. The rearmost one of said arms 41, i.e. the arm adjacent the wall, is formed in one piece with the flange member 25. The foremost one of said arms 40 is manufactured in one piece with the actual support arm 17. This arrangement brings substantial technical manufacturing advantages.

The inclined surfaces 42 at the inner end of the support arm 17 serve to facilitate the introduction of the flange member 25 together with the parts fastened thereto. This inclined surface also favours the depression of the location pin 30 during introduction of the set screw 15 into the rectangular section aperture 23 of the support arm 17.

The arrangement of the steel sleeve 19 in an internal bore of the flange member 25 is particularly important in ensuring that the positioning forces of the set screws 18 are transmitted to the thinner end 15' of the set bolt 15 via a greater surface area of the plastic flange member 25. The round end 15' is constructed to be significantly weaker than the rectangular section part in order that a certain degree of deflectability of this part is ensured during adjustment of the adjustment screws 18. The somewhat thinner round end 15' extends until the start of the rectangular section central aperture in the support arm 17. The steel sleeve 19 also extends to this point and has a radially directed flange or collar 43 which enlarges the contact area with the plastic flange member 25. If the flange member 25 is formed in one piece with the actual support arm 17, then the collar 43 can be omitted.

In accordance with a particularly preferred embodiment, the filling pieces 12 consist of the same material as the support arm 17 itself. In this case, the filling pieces 12 are not elastically deformable but are in contrast relatively stiff. In this case, it is important that the support arms 17 are open in the direction towards the end cap 21 so that the filling pieces or strips 12 can be inserted from this location. The subsequently plugged in cap 21 then locates the filling pieces 12 in the axial direction. The filling pieces 12 can also be selectively drawn out of the grooves 11 on removing the end cap 21.

The cross sectional T-form of the grooves 11 and of the filling pieces 12 which can be seen from FIGS. 3 to 5 is particularly favourable for the axial insertion of the filling pieces 12 and prevents the pushed in filling pieces 12 from falling out radially.

The filling pieces 12 preferably have a rounded surface as can be seen from FIG. 3 so that they continuously blend with the rounded surface of the support arm 17 and thus that the outward impression is gained of a unitary component. If the filling pieces are constructed in accordance with this preferred embodiment then they will also play a significant role in contributing to the stiffness of the support arm.

Further modification will be apparent to those skilled in the art without departing from the scope of the present teaching.

We claim:

1. A support arm assembly for fastening to a wall, said assembly comprising a support arm, a pressure plate bearing on the wall, a securing screw having a threaded end passing substantially centrally through said pressure plate for engagement in said wall and a head end located outside said wall for carrying said support arm, flange means axially facing said pressure plate and being adapted to exert a bending moment on said securing screw, and at least three adjustment screws spaced around said securing screw and acting between said pressure plate and said flange means so that on rotation of each said adjustment screw the distance between said flange means and said pressure plate is varied at the location of that screw, thereby tilting the flange means relative to the wall and thus exerting said bending moment on said securing screw and deflecting the same to align said head end and said support arm relative to said wall.

2. A support arm assembly in accordance with claim 1 and wherein said support arm has a plurality of longitudinally extending grooves displaced at intervals around its periphery, said grooves being adapted to receive marginal edge regions of associated plate members which are to be supported by the arm and being closable when not required by removable elongate filling pieces.

3. A support arm assembly in accordance with claim 2 wherein said support arm has four of said longitudinally extending grooves displaced at 90° intervals around its periphery, and wherein four said adjustment screws are provided, with each said adjustment screw being accessible through a respective one of said longitudinally extending grooves.

4. A support arm assembly in accordance with claim 2 and wherein neighbouring longitudinally extending grooves are connected by threaded passages at at least one point along their length, there being grub screws provided in said threaded passages.

5. A support arm assembly in accordance with claim 4 wherein four said longitudinally extending grooves are provided and wherein each said grub screw is directed from one groove to a neighbouring groove at an angle of 45° to the plane occupied by a plate when the same is in position in said neighbouring groove, said grub screw having a conical point of 90° included cone angle at its tip and means at its tail end for effecting rotation thereof, said means being accessible through said one groove and said grub screws being shorter in length than said threaded passages.

6. A support arm assembly in accordance with claim 5 and wherein said support arm has a central passage and each said grub screw passes through the material surrounding the central passage but does not break into the same.

7. A support arm assembly in accordance with claim 1 and wherein said head end of said centering screw is located in an elongate passage in said support arm.

8. A support arm assembly in accordance with claim 1 and wherein the head end of said securing screw has a larger cross-sectional dimension than said threaded end.

9. A support arm assembly in accordance with claim 1 wherein said adjustment screws are provided in threaded bores in said flange means.

10. A support arm assembly in accordance with claim 9 wherein said flange means includes a metal sleeve and wherein said bending moment is exerted on said securing screw via said metal sleeve.

11. A support arm assembly in accordance with claim 10 and wherein said metal sleeve has a collar which bears on said head end.

12. A support arm assembly in accordance with claim 9 and wherein a radially directed arm is provided on said flange means, said radially directed arm being positioned, in operation, directly adjacent the wall.

13. A support arm assembly in accordance with claim 12 and wherein a second radially directed arm is provided on said support arm and cooperates with the first said radially directed arm on said flange member to form a holder for a plate member.

14. A support arm assembly in accordance with claim 9 and wherein a snap connection is provided between said flange means and said support arm.

15. A support arm assembly in accordance with claim 9 and wherein a distance piece is provided between said flange member and said pressure plate with said adjustment screws extending through said distance piece.

16. A support arm assembly in accordance with claim 15 and wherein said pressure plate is located in an annular recess in said distance piece.

17. A support arm assembly in accordance with claim 9 and wherein said pressure plate is disposed in an annular recess in said flange means.

18. A support arm for fastening to a wall, the arm having four longitudinally extending grooves displaced at 90° intervals around its periphery, the grooves being adapted to receive as required the marginal edge regions of associated plate members which are intended to be supported by the arm and be enclosable when not required to so receive associate plate member by removable elongate filling pieces; the arm including a central bolt for fastening it by a first end face to a wall and a pressure plate, defining an abutment surface with the wall, movably arranged around the bolt at said first end face; said bolt being surrounded by a sleeve in the vicinity of the abutment surface; said sleeve being located inside a flange member disposed generally between said pressure plate and said support arm with plug connection means joining said support arm to said flange member, said flange member including a plurality of adjustment screws for adjusting its inclination, and thus that of the support arm, relative to said pressure plate, and thus to said wall.

19. A support arm in accordance with claim 18 and in which said adjustment screws are accessible through said grooves.

20. A support arm according to claim 19 and in which four said adjustment screws are provided.

21. A support arm in accordance with claim 18 and in which the outside surface of said flange member lies flush with the peripheral surface of the support arm.

22. A support arm in accordance with claim 18 and in which said sleeve includes a radially directed load spreading flange.

23. A support arm according to claim 18 and in which said central bolt includes a portion of reduced diameter passing through said sleeve and said pressure plate for fastening to the wall whereby to permit bending of said reduced diameter portion to accommodate malalignment on adjustment of said adjustment screws.

24. A support arm in accordance with claim 18 and in which a distance piece is interposed between said flange member and said pressure plate.

25. A support arm in accordance with claim 24 and in which the outside surface of said distance piece lies flush with the outside surface of said flange member.

* * * * *